US007489241B2

(12) United States Patent
Miettinen et al.

(10) Patent No.: US 7,489,241 B2
(45) Date of Patent: Feb. 10, 2009

(54) METHOD IN CONNECTION WITH A WRISTOP COMPUTER AND A WRISTOP-COMPUTER SYSTEM

(75) Inventors: Michael Miettinen, Tuusula (FI); Erik Lindman, Espoo (FI); Sami Ruotsalainen, Helsinki (FI); Heikki Puuri, Vantaa (FI)

(73) Assignee: Suunto Oy, Vantaa (FI)

( * ) Notice: Subject to any disclaimer, the term of this patent is extended or adjusted under 35 U.S.C. 154(b) by 449 days.

(21) Appl. No.: 11/152,055

(22) Filed: Jun. 15, 2005

(65) Prior Publication Data

US 2005/0282650 A1 Dec. 22, 2005

(30) Foreign Application Priority Data

Jun. 16, 2004 (FI) ..... 20040832

(51) Int. Cl.
*A63B 57/00* (2006.01)

(52) U.S. Cl. ..... 340/572.1

(58) Field of Classification Search ..... 340/3.23, 340/572.1, 825; 273/259; 377/5; 434/392; 473/221, 199; 235/375
See application file for complete search history.

(56) References Cited

U.S. PATENT DOCUMENTS 4,991,850 A 2/1991 Wilhlem
5,688,183 A 11/1997 Sabatino et al.
5,709,610 A * 1/1998 Ognjanovic ..... 473/223
5,733,201 A 3/1998 Caldwell et al.
5,740,077 A 4/1998 Reeves
6,224,493 B1 * 5/2001 Lee et al. ..... 473/223
7,101,287 B1 * 9/2006 Wagner ..... 473/207
7,121,962 B2 * 10/2006 Reeves ..... 473/407
2003/0207718 A1 11/2003 Perlmutter

FOREIGN PATENT DOCUMENTS

FI 113347 B 4/2004
JP 8173586 A 7/1996

* cited by examiner

*Primary Examiner*—Brian A Zimmerman
*Assistant Examiner*—Nabil H Syed
(74) *Attorney, Agent, or Firm*—Birch, Stewart, Kolasch & Birch, LLP

(57) ABSTRACT

The invention relates to a method and system in connection with a wristop computer (20). In the method, the wristop computer (20) is used to determine at least one of the following data in a game of golf: position, time, height, distance travelled, or club used. According to the invention, the club striking the ball is determined with the aid of a measurement and at least one datum of the game of golf is recorded, in such a way that the recording is triggered from the measurement of the club (3) striking the ball (4).

36 Claims, 2 Drawing Sheets

METHOD IN CONNECTION WITH A WRISTOP COMPUTER AND A WRISTOP-COMPUTER SYSTEM

BACKGROUND OF THE INVENTION

1. Field of the Invention

The present invention relates to a method, in connection with a wristop computer wherein the wristop computer is used to determine at least one of the following data in a game of golf: position, time, height. distance traveled, or club used. According to the invention, the club striking the ball is determined with the aid of a measurement and at least one datum of the game of golf is recorded, in such a way that the recording is triggered from the measurement of the club striking the ball.

The invention also relates to a wristop-computer system.

2. Description of the Prior Art

According to the prior art, wristop computers include several different functions to be applied to different leisure activities.

Particularly in devices intended for golfers, there are functions that allow the game performance to be monitored in various ways. Wristop computers equipped with a GPS positioning device can be used to monitor stroke-by-stroke preselected map data and the distance used in the game and to record the data, which can be used for after-game analysis, to develop playing skills.

Some wristop computers permit the entry of data on the club used, as part of the information being collected. Though this information is useful for game analysis, concentration on the game can often lead to the club-data entry being forgotten. When using this procedure, the user themselves must also press a key to enter the location of their stroke into the memory of the device.

U.S. Pat. No. 5,740,077 discloses a device for assisting playing golf, in which pressing a key records the stroke location in a device including a positioning system. In the same connection, information on the club used can also be recorded. In this solution, the player is responsible for recording both the stroke location and the club information. Practice has shown that, when using this procedure, the recording operation is easily forgotten.

SUMMARY OF THE INVENTION

The present invention is intended to eliminate the defects of the state of the art disclosed above and for this purpose create an entirely new type of solution.

The invention is based on detecting a stroke event by measurement based on, for example, vibration, pressure, or sound and recording, at the moment of striking the ball, at least some golf information, for example the location data of the stroke, in the memory of the device.

According to one preferred embodiment of the invention, a reading device implemented using radio-frequency technology is used in the wristop computer, while the club has a corresponding RFID identifier relating to the technology and, in connection with the striking situation, the RFID identifier's data is read to the wristop computer, triggered by the sound or vibration caused by striking the ball.

According to a second preferred embodiment, the detection is implemented as detection of the sound of the strike. Other preferred embodiments of the invention are acceleration detection, or a mechanical switch, which triggers the detection event at the moment of striking the ball.

According to a third preferred embodiment, the detection is implemented using the acceleration sensors of a compass device in the wristop computer, particularly on the basis of derivative data of the acceleration sensors.

More specifically, the method according to the invention wherein a wristop computer is used to determine at least one of the following data in a game of golf: position, time, height, distance traveled, or club used. According to the invention, the club striking the ball is determined with the aid of a measurement and at least one datum of the game of golf is recorded, in such a way that the recording is triggered from the measurement of the club striking the ball.

The system according to the invention wherein a wristop computer is able to determine at least one of the following data in a game of golf: position, time, height, distance traveled, or club used, characterized in that the system includes measuring means in the wristop computer for detecting a strike event, and means for recording at least one datum of the game of golf, in such a way that the recording is triggered from the measurement of the club striking the ball.

Considerable advantages are gained with the aid of the invention.

When the reading moment is created with the aid of measurement of the contact between the club and the ball, the triggering method according to the invention permits the correct location and, if desired, the club used in the stroke, to always be recorded.

In terms of the wristop computer, a greater advantage is the fact that the power consumption of the reading device can be minimized, as the reading stage, which requires power, is needed for only a short time and at precisely the correct moment. In addition, the power needed for reading can minimized, as of course the object being read is very close to the wristop computer at the moment of striking.

In addition, the placing of the RFID identifier in the club and the reader on the wrist facilitates reading the correct identifier, as this identifier will be as close as possible at the moment of striking and for some time afterwards.

From the user's point of view, the advantage is that the recording of the type of club always takes place automatically, so that not even intense concentration on the game will lead the recording of the information being forgotten.

Further, the time of the stroke, the possible parameters relating to the swing, and the position of the stroke are recorded automatically, with no interaction being demanded from the user. Thus the user of the device can concentrate totally on their game performance and nevertheless have the most important data recorded for analysis of the game. The user of the wristop computer can analyse the game and choice of clubs after a round of golf, because the club and position data can be used to calculate, for example, how far the user of the device has struck the ball with each club.

BRIEF DESCRIPTION OF THE DRAWINGS

In the following, the invention is examined with the aid of examples of applications according to the accompanying drawings.

DETAILED DESCRIPTION

Figure 1:
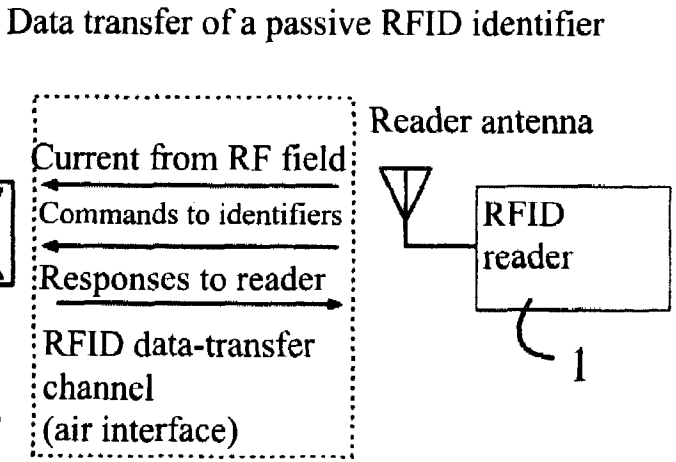
FIG. 1 shows schematically one environment according to the prior art, to which the invention can be applied.

According to FIG. 1, the RFID system consists of a reading device 1 and RFID identifiers 2, which are powered by the transmission power of the transmitter 1. The commands travel to the identifier 2 over the air at radio frequency while correspondingly messages from the identifier to the reading device 1 travel over the same transmission path.

Figure 2:
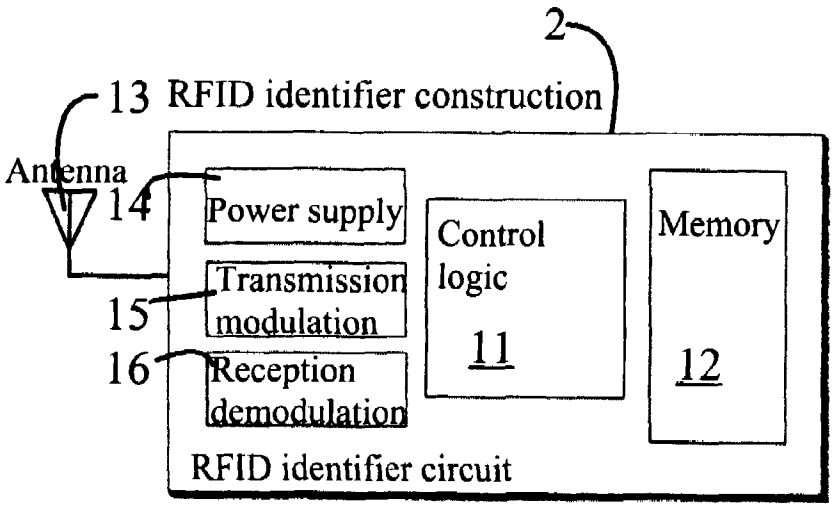
FIG. 2 shows the RFID component of the system of FIG. 1 in greater detail.

According to FIG. 2, the RFID typically includes a power supply 14 charged by radio-frequency energy. The power supply 14 is used to supply power to the other components, to the control logic 11, the memory 12, the receiver-modulation circuit 16, and the transmission-modulation circuit 15. An antenna 13 is used for transmission and reception.

Figure 3:
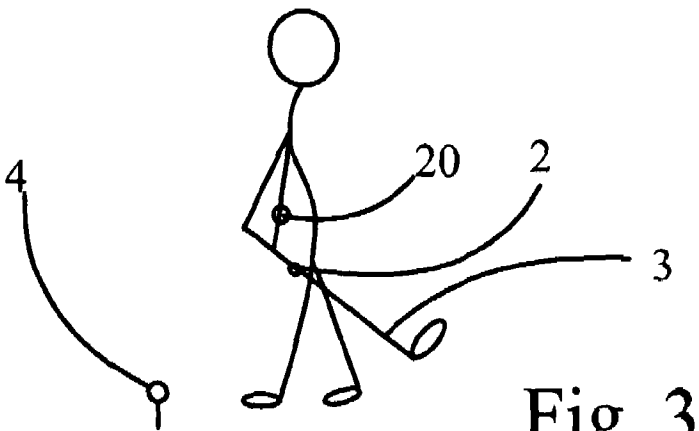
FIG. 3 shows schematically the system according to the invention.

According to FIG. 3, passive RFID identifiers 2, which contain data (make, model, blade angle, etc.) relating to the identification of the club, are attached to the golf clubs 3. The attachment to the clubs 3 can be made by the user themselves, or the identifiers 2 can be integrated in the club 3 already when manufacturing the clubs.

The wristop computer 20 includes means for detecting a stroke. Typically, the wristop computer 20 also includes a positioning system (e.g., GPS) and an RFID reader 1.

According to the invention, an RFID identifier 2, which contains information on the club used (driver, p3, i5, etc.), is attached to the golf club 3. The wristop computer 20 detects the stroke. Detection of a stroke activates, for the time required, the RFID reader 1, which reads the data from the nearest RFID identifier 2 (the club in the user's hand) and records them in the memory of the device 20. Stroke activation typically also records the time of day and the location data (if this is used) in the memory of the device 20.

Stroke detection can be implemented with the aid of sound, for example, with the aid of the pressure sensor of the wristop computer 20, expressed as an individual pressure peak. Alternatively, an acceleration sensor can be arranged in the wristop computer 20, which expresses the acceleration peak associated with striking the ball 4. Alternatively, a mechanical switch can be placed in the wristop computer, which can be suitably adjusted to act as a stroke detector.

The RFID identifier 2 is preferably located in the club so as to be sufficiently close to the wristop computer 20 in the striking situation. A suitable location is, for example, the hand grip of the club 3. One preferred location for the RFID identifier 2 is, according to the invention, as close as possible to the wristop computer 20.

Figure 4:
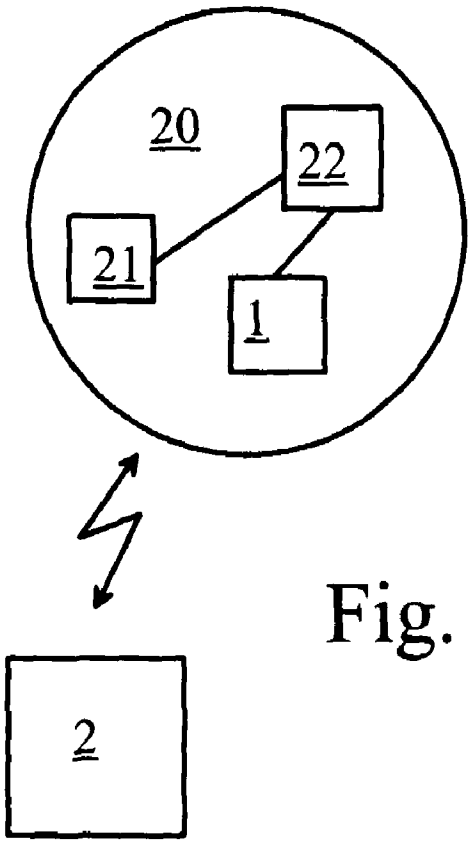
FIG. 4 shows a block diagram of the system according to the invention.

According to FIG. 4, the wristop computer 20 includes a control unit 22, to which a trigger circuit 21 is connected. The control unit 22 is typically a microprocessor. The RFID reading device 23, which is controlled with the aid of the control unit 22, is connected to the control unit 22. When the control unit 22 receives a suitable signal from the trigger unit 21, the reader device 1 begins to operate for a predefined length of time and reads the RFID identifier 2 from the club and records it in the memory of the wristop computer 20, preferably together with the location and time-of-day information.

Figure 5:
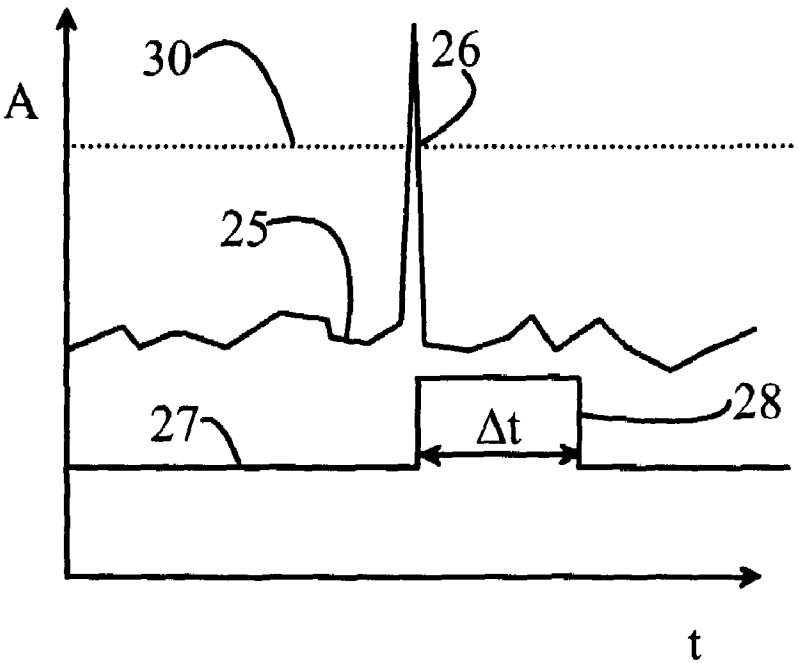
FIG. 5 shows graphically a timing diagram of the solution according to the invention.

According to FIG. 5, the signal 25 depicts the signal data used by the trigger unit, which can be pressure, acceleration, or, for instance, the switch's position data. The signal 25 is typically received from a sensor 20 or switch situated in the wristop computer 20. If the amplitude of the signal 25 exceeds a predefined limit 30, a control signal 27 is used to give a command 28 to the reading unit 1 to start reading the RFID identifier 2. The reading lasts for a predefined length of time Δt, after which the reading event is terminated.

The signal 25 can come directly from a suitable sensor, or it can be suitably filtered, to be able to express the correct maximum 26. The control pulse 27 can be an ENABLE pulse according to FIG. 5, the duration of which determines the duration of the reading event Δt. Alternatively, the control of the reading event can consist of individual pulses of short duration, one of which starts and another ends the reading event. The duration of the reading event Δt is typically from a few milliseconds to a few seconds. For its part, the power of the transmitter 1 varies from a few hundreds of milliwatts to a few watts.

The termination of the reading event Δt can also be implemented by the control unit 22 at the moment in time at which the reading device 1 has successfully detected one RFID identifier 2, so that the duration of the reading event Δt is not constant.

According to one preferred embodiment of the invention, a wristop computer, which includes an electrical compass, which further includes at least one acceleration sensor, and, is used. In this embodiment, a value derived from the acceleration signal is monitored and, if it exceeds a specific threshold value, then from that moment a specific number of samples of the original signal are summed together. This corresponds to integration and the operation is used to check that the signal contained enough power for a sufficiently long time for it to come from a real stroke, and not just an accidental knock. If the value of the calculated integral also exceeds the threshold value, then a stroke and hit have taken place and the necessary operations are performed to read the location of the stroke and the code of the club and to record the information.

The signal 25 can also be the derivative of acceleration or pressure relative to time.

According to one preferred embodiment of the invention, the signal 25 is the signal of a pressure sensor in the wristop computer suitably processed.

What is claimed is:

1. A method in connection with a wristop computer, in which the wristop computer detects a strike event with the aid of a measurement, and at least one datum of the game of golf, is recorded, comprising:

detecting a strike event with the aid of a measurement;

determining a GPS position of the user when the strike event is detected; and recording at least the GPS position of the user within a wearable wristop computer after the determination of the GPS position of the user is completed.

2. A method according to claim 1, wherein the method further com rises the step of:

determining a RFID identifier of the golf club when the strike event is detected; and recording the RFID identifier of the golf club within a wearable wristop computer after the determination of the RFID identifier of the golf club completed.

3. A method according to claim 1 or 2, wherein the step of detecting a strike event with the aid of a measurement, further comprises:

detecting the strike event when a pressure of a specific club exceeds a predefined threshold value.

4. A method according to claim 1 or 2, wherein the step of detecting a strike event with the aid of a measurement, further comprises:

detecting the strike event when an acceleration of a specific club exceeds a predefined threshold value.

5. A method according to claim 4, wherein the step of detecting the strike event when an acceleration of a specific club exceeds a predefined threshold value, further comprises:

monitoring the value of the derivative of the acceleration signal and when it exceeds a predefined threshold value, then from that moment a specific number of samples of the original signal are summed and, if the value of the sum thus obtained exceeds a threshold value, the stroke and hit are interpreted as having taken place.

6. A method according to claim 1, wherein the step of detecting a strike event with the aid of a measurement, further comprises:

detecting the strike event using a mechanical switch.

7. A method according to claim 1, wherein the step of determining terminates when the GPS position is successfully read.

8. A method according to claim 2, wherein the step of determining terminates when one RFID sign is successfully read.

9. A wristop computer system, which includes a wristop computer that is able to detect a strike event with the aid of a measurement, and at least one datum of the game of golf is recorded, wherein the system includes:

a wristop computer further comprising:

a strike event detecting means for detecting a strike event with the aid of a measurement;

a data determining means for determining a GPS position of the user when the strike event is detected; and a recording means for recording at least the GPS position of the user within a wearable wristop computer after the determination of the GPS position of the user is completed.

10. A wristop computer system according to claim 9, wherein the system further comprises:

a club determining means for determining a RFID identifier of the golf club when the strike event is detected; and a recording means for recording the RFID identifier of the golf club within a wearable wristop computer after the determination of the RFID identifier of the golf club completed.

11. A wristop computer system according to claim 9, wherein the strike event detecting means detects a strike event when a pressure of a specific club exceeds a predefined threshold value.

12. A wristop computer system according to claim 9, wherein the strike event detecting means detects a strike event when an acceleration of a specific club exceeds a predefined threshold value.

13. The strike event detecting means according to claim 12, further comprises:

monitoring a value derived from the acceleration signal in such a way that, if the acceleration exceeds a predefined threshold value, then from that moment a specific number of samples of the original signal are summed and, if the value of the sum thus obtained exceeds a threshold value, the stroke and hit are interpreted as having taken place.

14. A wristop computer system according to claim 9, wherein the strike event detecting means detects a strike event using a mechanical switch.

15. The data determining means according to claim 9, wherein determining the GPS position terminates when the GPS position is successfully read.

16. The data determining means according to claim 10, wherein determining a RFID identifier terminates when one RFID sign is successfully read.

17. A method in connection with a wristop computer, in which the wristop computer detects a strike event with the aid of a measurement, and at least one datum of the game of golf is recorded, comprising:

detecting a strike event with the aid of a measurement;

determining a RFID identifier of the golf club when the strike event is detected; and recording the RFID identifier of the golf club within a wearable wristop computer after the determination of the RFID identifier of the golf club completed.

18. A method according to claim 17, wherein the method further comprises the steps of:

determining the at least one of the following datum in a game of golf: GPS position of the user, time of day, height of the golf ball, or distance the golf ball traveled, when the strike event is detected; and recording at least the one datum of the game of golf within a wearable wristop computer after the determination of the at least one of the datum of a game of golf is completed.

19. A method according to claim 18, wherein the step of determining is performed for a predefined duration.

20. A method according to claim 17, wherein the step of detecting a strike event with the aid of a measurement, further comprises:

detecting a strike event when a pressure of a specific club exceeds a predefined threshold value.

21. A method according to claim 17, wherein the step of detecting a strike event with the aid of a measurement, further comprises:

detecting a strike event when an acceleration of a specific club exceeds a predefined threshold value.

22. A method according to claim 21, wherein the step of detecting a strike event when an acceleration of a specific club exceeds a predefined threshold value, further comprises:

monitoring the value of the derivative of the acceleration signal and, when it exceeds a predefined threshold value, then from that moment a specific number of samples of the original signal are summed and, if the value of the sum thus obtained exceeds a threshold value, the stroke and hit are interpreted as having taken place.

23. A method according to claim 17, wherein the step of detecting a strike event with the aid of a measurement, further comprises:

detecting a strike event using a mechanical switch.

24. A method according to claim 17, wherein the step of determining terminates when one RFID sign is successfully read.

25. A wristop computer system, which includes a wristop computer that is able to detect a strike event with the aid of a measurement, and at least one datum of the game of golf is recorded, wherein the system includes:

a wristop computer further comprising:

a strike event detecting means for detecting a strike event with the aid of a measurement;

a data determining means for determining a RFID identifier of the golf club when the strike event is detected; and a recording means for recording the RFID identifier of the golf club within a wearable wristop computer after the determination of the RFID identifier of the golf club completed.

26. A wristop computer system according to claim 25, wherein the system further comprises the steps of:

a determining means for determining the at least one of the following datum in a game of golf: GPS position of the user, time of day, height of the golf ball, or distance the golf ball traveled, when the strike event is detected; and a recording means for recording at least the one datum of the game of golf within a wearable wristop computer after the determination of the at least one of the datum of a game of golf is completed.

27. The data determining means according to claim 26, wherein the data determining means determines for a predefined duration.

28. A wristop computer system according to claim 25, wherein the strike event detecting means detects a strike event when a pressure of a specific club exceeds a predefined threshold value.

29. A wristop computer system according to claim 25, wherein the strike event detecting means detects a strike event when an acceleration of a specific club exceeds a predefined threshold value.

30. The strike event detecting means according to claim 29, further comprises:

monitoring a value derived from the acceleration signal in such a way that, if the acceleration exceeds a predefined threshold value, then from that moment a specific number of samples of the original signal are summed and, if the value of the sum thus obtained exceeds a threshold value, the stroke and hit are interpreted as having taken place.

31. A wristop computer system according to claim 25, wherein the strike event detecting means detects a strike event using a mechanical switch.

32. The data determining means according to claim 25, wherein the step of determining terminates when one RFID sign is successfully read.

33. A method according to claim 1, wherein the method further comprises the steps of:

determining the at least one of the following datum in a game of golf: time of day, height of the golf ball, or distance the golf ball traveled, when the strike event is detected; and recording at least the one datum of the game of golf within a wearable wristop computer after the determination of the at least one of the datum of a game of golf is completed.

34. A method according to claim 33, wherein the step of determining is performed for a predefined duration.

35. A wristop computer system according to claim 9, wherein the system further comprises the steps of:

a determining means for determining the at least one of the following datum in a game of golf: time of day, height of the golf ball, or distance the golf ball traveled, when the strike event is detected; and a recording means for recording at least the one datum of the game of golf within a wearable wristop computer after the determination of the at least one of the datum of a game of golf is completed.

36. The data determining means according to claim 35, wherein the data determining means determines for a predefined duration.

* * * * *